US010351804B2

(12) United States Patent
Dabela et al.

(10) Patent No.: US 10,351,804 B2
(45) **Date of Patent: *Jul. 16, 2019**

(54) PRINTING PRESS CLEANING COMPOSITIONS

(71) Applicant: EXPLORER PRESSROOM SOLUTION, Santa Fe Springs, CA (US)

(72) Inventors: Raymond Dabela, Chino Hills, CA (US); Jeffrey L. Rogers, Long Beach, CA (US)

(73) Assignee: Explorer Pressroom Solution, Santa Fe Springs, CA (US)

( * ) Notice: Subject to any disclaimer, the term of this patent is extended or adjusted under 35 U.S.C. 154(b) by 92 days.

This patent is subject to a terminal disclaimer.

(21) Appl. No.: 15/153,505

(22) Filed: May 12, 2016

(65) Prior Publication Data

US 2016/0319223 A1 Nov. 3, 2016

Related U.S. Application Data

(63) Continuation of application No. 13/624,871, filed on Sep. 21, 2012, now abandoned, which is a continuation of application No. 12/118,408, filed on May 9, 2008, now abandoned, which is a continuation-in-part of application No. 11/747,812, filed on May 11, 2007, now Pat. No. 8,207,103.

(60) Provisional application No. 60/969,579, filed on Aug. 31, 2007.

(51) Int. Cl.

| | |
|---|---|
| ***C11D 3/16*** | (2006.01) |
| ***C11D 3/24*** | (2006.01) |
| ***C11D 9/24*** | (2006.01) |
| ***C11D 7/28*** | (2006.01) |
| ***B41N 3/00*** | (2006.01) |
| ***C11D 3/43*** | (2006.01) |
| ***C11D 7/50*** | (2006.01) |
| ***C11D 3/18*** | (2006.01) |
| ***C11D 17/00*** | (2006.01) |
| *C11D 7/24* | (2006.01) |

(52) U.S. Cl.

CPC ..... *C11D 3/162* (2013.01); *B41N 3/00* (2013.01); *C11D 3/188* (2013.01); *C11D 3/245* (2013.01); *C11D 3/43* (2013.01); *C11D 7/5027* (2013.01); *C11D 17/003* (2013.01); *C11D 7/242* (2013.01); *C11D 7/244* (2013.01); *C11D 7/245* (2013.01); *C11D 7/247* (2013.01); *C11D 7/28* (2013.01)

(58) Field of Classification Search

CPC ..... C11D 3/162; C11D 3/188; C11D 3/18; C11D 3/43; C11D 3/245; C11D 7/747; C11D 7/28; C11D 7/5027

USPC ..... 510/171, 203, 437, 170, 213; 106/311

See application file for complete search history.

(56) References Cited

U.S. PATENT DOCUMENTS

| | | | | |
|---|---|---|---|---|
| 5,691,288 | A * | 11/1997 | Dhillon | B41N 3/06 510/170 |
| 5,962,390 | A * | 10/1999 | Flynn | C07C 43/12 510/285 |
| 6,929,702 | B1 * | 8/2005 | Motsenbocker | C11D 3/43 134/40 |
| 2005/0277718 | A1 * | 12/2005 | Johnson | C08G 18/2825 524/261 |
| 2007/0135325 | A1 * | 6/2007 | Hawes | C09D 7/001 510/407 |
| 2008/0081871 | A1 * | 4/2008 | Sehgal | C08G 18/0866 524/591 |

* cited by examiner

*Primary Examiner* — Tri V Nguyen

(74) *Attorney, Agent, or Firm* — Elie Gendloff; Gendloff IP

(57) ABSTRACT

Disclose herein is a composition comprising a hydrocarbon solvent; an aromatic solvent; a methylated siloxane; and a surfactant. Also disclosed is a method of preparing an emulsion for cleaning purposes comprising mixing a solution at a rate of greater than 500 rpm for at least two hours, wherein the solution comprises a hydrocarbon solvent, an aromatic solvent, a methylated siloxane, and a surfactant. In addition, disclosed herein is a method of cleaning rollers, plates, or blankets of a printing machine with a cleaning mixture, the method comprising contacting the rollers or blankets with the cleaning mixture, wherein the cleaning mixture comprises a hydrocarbon solvent, an aromatic solvent, a methylated siloxane, and a surfactant.

16 Claims, No Drawings

PRINTING PRESS CLEANING COMPOSITIONS

RELATED APPLICATIONS

The present application is a continuation of U.S. application Ser. No. 13/624,871, filed Sep. 21, 2012, which is a continuation application of U.S. patent application Ser. No. 12/118,408, filed May 9, 2008, which is a continuation-in-part application of U.S. application Ser. No. 11/747,812, filed May 11, 2007, and claims benefit of priority to U.S. Provisional Application No. 60/969,579, filed Aug. 31, 2007. The entire disclosure of all of the above applications are incorporated by reference herein.

FIELD OF THE INVENTION

The present invention is in the field of cleaning solutions and mixtures, and particularly in the field of cleaning solutions and mixtures used in the printing industry.

BACKGROUND

Offset printing is a widely used printing technique where the inked image is transferred (or "offset") from a plate to a rubber blanket, then to the printing surface, e.g., paper. When used in combination with the lithographic process, which is based on the repulsion of oil and water, the offset technique employs a flat (planographic) image carrier on which the image to be printed obtains ink from ink rollers, while the non-printing area attracts a film of water, keeping the non-printing areas ink-free.

During the operation of the printing machine, ink regularly contaminates the non-printing areas, causing smears or smudges to appear on the printed surface, or in general interfere with the operation of the printing machine. In addition, pulp and dust from the paper used as the printing surface rises from the paper as the paper travels through the printing machine. This dust settles on the various parts of the printing machine, including the rollers, plates, and blankets, and contaminates these parts and interferes with the printing mechanism. In some applications, before they are fed to the printer, various pieces of paper are stacked on top of each other with a layer of spray powder, such as corn starch, separating them. The spray powder ensures that the pieces of paper do not stick together and are fed individually into the printing machine. Over time, the spray powder accumulates on the rollers, plates, and blankets and interferes with the printing mechanism.

Consequently, printing machines are cleaned regularly by applying a cleaning solution to the rollers, plates, and blankets to remove the ink and the grime from these parts. Traditionally, cleaning solutions have contained volatile organic compounds (VOCs). It is well-known that VOCs are not environmentally friendly. They are potential carcinogens, contribute to the depletion of the ozone layer, and may contribute to the green house effect that is responsible for global warming. As the result, governments have enacted restrictions on the use of VOCs in various industries, including the printing industry.

To comply with government regulations, various cleaning solutions having low VOC content have been marketed. These cleaning solutions are, for the most part, oil based. Oils have relatively low vapor pressures and are generally not considered to be volatile. However, oils are not satisfactory for use as printing machine cleaning agents. The oils in the cleaning solutions have a tendency to splatter. Once the oil has been used it accumulates at the bottom of the printing machine and then splatters on various parts, causing additional contamination. In addition, oils are difficult to remove and dispose.

Therefore, there is a need in the industry for a low VOC solvent that is compliant with governmental regulations, is economical to use, and cleans the printing machines efficiently and effectively.

SUMMARY OF THE INVENTION

Disclose herein is a composition comprising a hydrocarbon solvent; an aromatic solvent; a methylated siloxane; and a surfactant. Also disclosed is a method of preparing an emulsion for cleaning purposes comprising mixing a solution at a rate of greater than 500 rpm for at least two hours, wherein the solution comprises a hydrocarbon solvent, an aromatic solvent, a methylated siloxane, and a surfactant. In addition, disclosed herein is a method of cleaning rollers, plates, or blankets of a printing machine with a cleaning mixture, the method comprising contacting the rollers or blankets with the cleaning mixture, wherein the cleaning mixture comprises a hydrocarbon solvent, an aromatic solvent, a methylated siloxane, and a surfactant.

DETAILED DESCRIPTION OF THE ILLUSTRATED EMBODIMENTS

Thus, in one aspect, disclosed herein is a composition comprising a hydrocarbon solvent, an aromatic solvent, a methylated siloxane, and a surfactant.

In some embodiments, the hydrocarbon solvent comprises a linear or branched alkyl chain, a cycloalkyl, a double bond, a triple bond, or a combination thereof. In other embodiments, the hydrocarbon solvent is a natural product. In certain embodiments, the hydrocarbon solvent comprises a $C_5$-$C_{30}$ hydrocarbon. As used herein, "$C_m$ to $C_n$" in which "m" and "n" are integers refers to the number of carbon atoms in an alkyl, alkenyl, alkynyl and the rings of cycloalkyl and cycloalkenyl group. That is, the alkyl, alkenyl or alkynyl can contain from "m" to "n", inclusive, carbon atoms.

In some embodiments, the hydrocarbon solvent is a mixture of at least two $C_5$-$C_{30}$ hydrocarbons. Thus, as used herein, the term "hydrocarbon solvent" refers not only to a solvent containing a single chemical species, but also to a solvent containing a mixture of two or more chemical species, each chemical species being a hydrocarbon.

In some embodiments, the hydrocarbon solvent is selected from the group consisting of limonene, lacolene, and Solvent 142. Solvent 142 is a low odor petroleum distillate blend that is used as an industrial cleaning solvent, and is suitable for use where low flash point mixtures cannot be tolerated.

In some embodiments, the hydrocarbon solvent comprises a heteroatom (i.e., at least one heteroatom) within the chain. In these embodiments, the hydrocarbon solvent is selected from the group consisting of an ether, a thioether, a secondary amine, and a tertiary amine.

In some preferred embodiments, the hydrocarbon solvent is an ether. In some of these embodiments, the hydrocarbon solvent comprises a carbon chain backbone, which is substituted with one or more alkoxy substituents. In other embodiments, the carbon chain backbone is also substituted with one or more hydroxyl substituent. In these embodiments, the hydrocarbon solvent is an alcohol. In other embodiments, the carbon chain backbone is substituted with both one or more alkoxy substituents and one or more hydroxyl substituents.

Examples of ethers include, but are not limited to, the family of glycol ethers. Glycol ethers are a group of solvents based on alkyl ethers of ethylene glycol. These solvents typically have higher boiling point, together with the favorable solvent properties of lower molecular weight ethers and alcohols. The original glycol ether is ethyl cellosolve. Glycol ethers can be also derived of diethylene glycol (carbitols).

Glycol ether solvents include, but are not limited to, ethylene glycol monomethyl ether (2-methoxyethanol, $CH_3OCH_2CH_2OH$), ethylene glycol monoethyl ether (2-ethoxyethanol, $CH_3CH_2OCH_2CH_2OH$), ethylene glycol monopropyl ether (2-propoxyethanol, $CH_3CH_2CH_2OCH_2CH_2OH$), ethylene glycol monoisopropyl ether (2-isopropoxyethanol, $(CH_3)_2CHOCH_2CH_2OH$), ethylene glycol monobutyl ether (2-butoxyethanol, $CH_3CH_2CH_2CH_2OCH_2CH_2OH$) (also referred to as glycol ether EB), ethylene glycol monophenyl ether (2-phenoxyethanol, $C_6H_5OCH_2CH_2OH$), ethylene glycol monobenzyl ether (2-benzyloxyethanol, $C_6H_5CH_2OCH_2CH_2OH$), diethylene glycol monomethyl ether (2-(2-methoxyethoxy)ethanol, methyl carbitol, $CH_3OCH_2CH_2OCH_2CH_2OH$), diethylene glycol monoethyl ether (2-(2-ethoxyethoxy)ethanol, carbitol cellosolve, $CH_3CH_2OCH_2CH_2OCH_2CH_2OH$), diethylene glycol mono-n-butyl ether (2-(2-butoxyethoxy) ethanol, $CH_3CH_2CH_2CH_2OCH_2CH_2OCH_2CH_2OH$), ethylene glycol dimethyl ether (dimethoxyethane, $CH_3OCH_2CH_2OCH_3$), ethylene glycol diethyl ether (diethoxyethane, $CH_3CH_2OCH_2CH_2OCH_2CH_3$), ethylene glycol dibutyl ether (dibutoxyethane, $CH_3CH_2CH_2CH_2OCH_2CH_2OCH_2CH_2CH_2CH_3$), ethylene glycol methyl ether acetate (2-methoxyethyl acetate, $CH_3OCH_2CH_2OCOCH_3$), ethylene glycol monethyl ether acetate (2-ethoxyethyl acetate, $CH_3CH_2OCH_2CH_2OCOCH_3$), ethylene glycol monobutyl ether acetate (2-butoxyethyl acetate, $CH_3CH_2CH_2CH_2OCH_2CH_2OCOCH_3$). In some embodiments, the aromatic solvent comprises an optionally substituted phenyl ring. Unless otherwise indicated, when a compound, or a portion thereof, is deemed to be "optionally substituted," it is meant that the substituted compound, or portion thereof, is a group that may be substituted with one or more group(s) individually and independently selected from alkyl, alkenyl, alkynyl, cycloalkyl, aryl, heteroaryl, heteroalicyclic, hydroxyl, alkoxy, aryloxy, mercapto, alkylthio, arylthio, cyano, halo, carbonyl, thiocarbonyl, O-carbamyl, N-carbamyl, O-thiocarbamyl, N-thiocarbamyl, C-amido, N-amido, S-sulfonamido, N-sulfonamido, C-carboxy, O-carboxy, isocyanato, thiocyanato, isothiocyanato, nitro, silyl, trihalomethanesulfonyl, and amino, including mono- and di-substituted amino groups, and the protected derivatives thereof. The protecting groups that may form the protective derivatives of the above substituents are known to those of skill in the art and may be found in references such as Greene and Wuts, Protective Groups in Organic Synthesis, 3rd Ed., John Wiley & Sons, New York, N.Y., 1999, which is incorporated herein in its entirety.

In some embodiments, the aromatic solvent is a mixture of at least two compounds, each of which comprises an optionally substituted phenyl ring. Thus, as used herein, the term "aromatic solvent" refers not only to a solvent containing a single chemical species, but also to a solvent containing a mixture of two or more chemical species, each chemical species being an aromatic compound.

In some embodiments, the aromatic solvent comprises an optionally substituted halobenzene. A "halobenzene" is a benzene or phenyl group that is substituted with one or more halogens, such as fluoro, chloro, bromo, or iodo. In certain embodiments, the aromatic solvent comprises an optionally substituted perhaloalkylbenzene. A "perhaloalkylbenzene" is a benzene or phenyl group that is substituted with one or more alkyl groups, all of whose hydrogen atoms have been replaced by a halogen. Examples of perhaloalkyl groups include, but are not limited to, trifluoromethyl, trichloromethly, tribromomethyl, pentafluoroethyl, pentachloroethly, and the like. In some embodiments, the aromatic solvent is 1-chloro-4-(trifluoromethyl)benzene, also known as parachlorobenzotriflouride (PCBTF) or "Oxol 100®". In some embodiments, the halobenzene is present in the range of between 15-45% by volume. In other embodiments, the halobenzene is present in the range of between 20-40% by volume. In yet other embodiments, the halobenzene is present in the range of between 20-30% by volume.

In some embodiments, the methylated siloxane is a cyclic, branched, or linear methylated siloxane. A siloxane comprises several terminal —OH groups. In a "methylated siloxane" the hydrogen atom of at least one of the —OH groups is replaced with a methyl group. In some embodiments, the methylated siloxane comprises between 4-20 methyl groups.

In some embodiments, the methylated siloxane is a mixture of at least two methylated siloxanes. Thus, as used herein, the term "methylated siloxane" refers not only to a solvent containing a single chemical species, but also to a solvent containing a mixture of two or more chemical species, each chemical species being a methylated siloxane.

In some embodiments, the methylated siloxane is selected from the group consisting of octamethylcyclotetrasiloxane, also known as cyclomethicone or D4, decamethylcyclopentasiloxane (SF 1202 or D5), dodecamethylcyclohexasiloxane (also known as D6), and a combination thereof.

Cyclic, branched, or linear, completely methylated siloxanes (VMS) are listed within group II as exempt compounds under South Coast Air Quality Management District (SCAQMD) Rule 102. SCAQMD Rule 1171 prohibits the use of group II compounds but specifically allows the use of VMS. In some preferred embodiments, the methylated siloxanes used in the compositions disclosed herein are only the cyclic volatile completely methylated siloxanes.

Dow Corning 244 fluid consists of greater than 60 percent octamethylcyclotetrasiloxane (D4). Dow Corning 345 fluid is a mixture of 30 to 40 percent dodecamethylcyclohexasiloxane (D6) with the balance being decamethylcyclopentasiloxane. Dow Corning OS-10 consists of greater than 60 percent hexamethyldisiloxane (HMDS), which is a linear, volatile, completely methylated siloxane. In some embodiments, the Dow Corning fluid is present in the range of between 15-55% by volume. In other embodiments, the Dow Corning fluid is present in the range of between 25-50% by volume. In yet other embodiments, the Dow Corning fluid is present in the range of between 25-35% by volume.

In some embodiments, the surfactant can also act as an emulsifier. Typically, surfactants are long chain hydrocarbons, which may comprise one or more points of unsaturation, i.e., double (both cis and trans) or triple bonds. In some embodiments, the surfactant comprises a fatty acid or a salt or ester thereof.

Fatty acids are long chain hydrocarbons, typically containing a carboxyl group at one terminus, which are normally obtained from hydrolyzing fats or oils. Some synthetic long chain hydrocarbons can also be called fatty acids, even though they are not obtained from naturally occurring fats or oils. In the context of the present disclosure, the term "fatty acid" includes any long chain hydrocarbon, even if the chain does not contain a carboxyl group. By "long chain" it is meant that the hydrocarbon chain comprises 5-50 carbon atoms (e.g., a $C_5$-$C_{50}$ chain). In some embodiments, the fatty acid is selected from the group consisting of caproic acid, caprylic acid, capric acid, lauric acid, myristic acid, palmitic acid, stearic acid, arachidic acid, behenic acid, myristoleic acid, palmitoleic acid, oleic acid, linoleic acid, alpha-linolenic acid, arachidonic acid, eicosapentaenoic acid, erucic acid, and docosahexaenoic acid. In some embodiments, the fatty acid is oleic acid.

In some embodiments, the surfactant is a salt or ester of oleic acid, which can optionally be selected from, for example, sorbitan monooleate or methyl oleate.

In other embodiments, the surfactant is a salt or ester of linolenic acid, for example, the methyl ester of linolenic acid.

In some embodiments, the surfactant is a mixture of fatty acid esters. Examples of such mixtures include NORFOX® MSY (methyl soyate) (Norman, Fox & Co., Vernon, Calif.), which is predominantly (51.5%) the methyl ester of linolenic acid.

In some embodiments, the surfactant is a salt of an alkyl aromatic sulfonic acid. This particular surfactant can be an amine, alkali metal, or ammonium salt of an alkyl aromatic sulfonic acid as an anionic emulsifier. The alkylaromatic hydrophobe solubilizes well in oily mixtures. This surfactant emulsifier produces little foam, compared to conventional anionic surfactants. The surfactant may be an amine, alkali metal, or ammonium salt of an alkyl benzene or alkyl naphthalene sulfonic acid. Examples include, but are not limited to, an isopropylamine salt of linear dodecylbenzene sulfonic acid, an isopropylamine salt of branched dodecylbenzene sulfonic acid, a diethanolamine salt of linear or branched dodecylbenzene sulfonic acid, and the like, as well as mixtures thereof. In some embodiments, the alkyl aromatic sulfonic acid is isopropylamine linear dodecylbenzene sulfonate (CALIMULSE PRS). In other embodiments, the alkyl aromatic sulfonic acid is the sodium salt of dodecylbenzene sulfonate (NORFOX® 40).

In some embodiments, the surfactant is a mixture of at least two surfactants. Thus, as used herein, the term "surfactant" refers not only to a solvent containing a single chemical species, but also to a solvent containing a mixture of two or more chemical species, each chemical species acting as a surfactant.

In some embodiments, the composition described herein comprises less than 50% by volume of a hydrocarbon solvent, less than 75% by volume of an aromatic solvent, less than 75% by volume of a methylated siloxane, and less than 75% by volume of a surfactant. In other embodiments, the composition described herein comprises less than 40% by volume of a hydrocarbon solvent, less than 50% by volume of an aromatic solvent, less than 50% by volume of a methylated siloxane, and less than 50% by volume of a surfactant. In yet other embodiments, the composition described herein comprises less than 35% by volume of a hydrocarbon solvent, less than 30% by volume of an aromatic solvent, less than 40% by volume of a methylated siloxane, and less than 20% by volume of a surfactant.

In some embodiments, the compositions described herein further comprise water. In some embodiments, the water is deionized water. In other embodiments, the water is distilled water.

The compositions disclosed herein have the advantage that they comprise low VOC components, i.e., the VOC content of the compositions is less than 200 g/L, and in some embodiments less than 150 g/L, in other embodiments 100 g/L, and in certain embodiments, less than 100 g/L.

In some embodiments, the compositions disclosed herein comprise less than 200 g/L of VOCs before water is added. After distilled water is added, the VOC content of the compositions is less than 100 g/L.

In some embodiments, the compositions disclosed herein comprise at least one basic component. The inclusion of the basic component is useful in cleaning the metal components of the printing press. In some embodiments, the basic component is soda ash, i.e., sodium carbonate. In other embodiments, the basic component is sodium tripolyphosphate. In certain embodiments, the basic component comprises sodium metasilicate. In other embodiments, the basic component comprises more than one basic component.

In another aspect, disclosed herein is a composition comprising an aromatic solvent, a methylated siloxane, and a surfactant, as these terms are described herein.

In another aspect, disclosed herein is a composition comprising a hydrocarbon solvent, a methylated siloxane, and a surfactant, as these terms are described herein.

In another aspect, disclosed herein is a composition comprising a hydrocarbon solvent, an aromatic solvent, and a surfactant, as these terms are described herein.

In another aspect, disclosed herein is a composition comprising a hydrocarbon solvent, an aromatic solvent, and a methylated siloxane, as these terms are described herein.

In some embodiments, the composition described herein is in the form of a solution, whereas in other embodiments, the composition is an emulsion.

Thus, in another aspect, described herein is a method of preparing an emulsion for cleaning purposes comprising mixing a solution at a rate of greater than 500 rpm for at least two hours, wherein the solution comprises a hydrocarbon solvent, an aromatic solvent, a methylated siloxane, and a surfactant, as these terms are described above. In some embodiments, the solution is mixed for about 4 hours. In other embodiments, the solution is mixed for about 8 hours. In yet other embodiments, the solution is mixed for about 12 hours. In further embodiments, the solution is mixed for about 24 hours. In other embodiments, the solution is mixed for longer than 24 hours.

In some embodiments, the solution is mixed at a rate of about 600 rpm. In other embodiments, the solution is mixed at a rate of less than 4000 rpm. In certain embodiments, the solution is mixed at a rate of between 600-3600 rpm.

The compositions described herein are best used for cleaning certain parts of printing machines, such as rollers, plates, or blankets. Thus, in another aspect, disclosed herein is a method of cleaning rollers, plates, or blankets of a printing machine with a cleaning mixture, the method comprising contacting the rollers or blankets with the cleaning mixture, wherein the cleaning mixture comprises a hydrocarbon solvent, an aromatic solvent, a methylated siloxane, and a surfactant, as these terms are described above. In some embodiments, the cleaning mixture is a solution, whereas in other embodiments, the cleaning mixture is an emulsion.

The compositions disclosed herein provide a low VOC (volatile organic compounds) wash mixtures that are effective in a wide range of applications. These compositions can be used on, for example, sheet fed, automatic, web, or heat set printing machines. In some embodiments, the compositions are used in an automated cleaning system, while in other embodiments, the compositions are used manually to clean the printing presses.

When the operator of the printing machine decides that the parts of the printing machine, such as rollers, plates, or blankets, need to be cleaned, the operator can stop the ink and water flow to the rollers, and then pour the cleaning mixture, whether the solution or the emulsion, over the rollers. The cleaning solution moves through the printing machine and flows downwards, as ink or water would, and cleans the surface areas with which it comes in contact. In some embodiments, it is not necessary to stop the flow of paper through the printing machine during the cleaning cycle because the cleaning cycle takes a short amount of time. In other embodiments, the operator first stops the flow of paper through the printing machine and then, while the rollers and plates are still rotating, applies the cleaning mixture.

EXAMPLES

The following examples are non-limiting and presented only to illustrate some of the embodiments disclosed herein.

Example 1

Blanket and Roller Wash Mixtures

The following mixtures provide a low VOC (volatile organic compounds) roller and blanket wash mixture that is effective in a wide range of applications. The following mixtures can be used on, for example, sheet fed, automatic, web, or heat set printing machines. In the following, all volume fractions were determined at room temperature.

Mixture 1

| Ingredients | Volume Fraction |
|---|---|
| d-Limonene | 0.08 |
| Oxol 100 ® | 0.23 |
| Solvent 142 | 0.03 |
| Dow Corning 345 fluid | 0.38 |
| PRS | 0.007 |
| SMO | 0.025 |
| MOL | 0.12 |
| Deionized water | 0.128 |
| Net | 1 |

Alternative Mixture 1

| Ingredients | Volume Fraction |
|---|---|
| d-Limonene | 0.08 |
| Oxol 100 ® | 0.23 |
| Solvent 142 | 0.03 |
| Dow Corning 244 fluid | 0.38 |
| PRS | 0.007 |
| SMO | 0.025 |
| MOL | 0.12 |
| Deionized water | 0.128 |
| Net | 1 |

"Oxol 100®" is the trade name of Occidental Chemical Co. for parachlorobenzotriflouride (PCBTF). The IUPAC name for PCBTF is 1-chloro-4-(trifluoromethyl) benzene. The level of 23% (0.23 volume fraction) for PCBTF is close to the safe upper limit for functionality, as PCBTF at higher fractions can damage the rubber used in printing blankets and rollers. Additionally PCBTF has what many people find to be an objectionable odor.

"MOL" stands for methyl oleate. "SMO" stands for sorbitan monooleate. "PRS" stands for isopropylamine linear dodecylbenzene sulfonate (CALIMULSE PRS), which is available commercially from Pilot Chemical Company of Santa Fe Springs, Calif.

Mixture 2

| Ingredients | Volume Fraction |
|---|---|
| Lacolene | 0.135 |
| Oxol 100 | 0.23 |
| Dow Corning OS-10 | 0.315 |
| Acetone | 0.32 |
| Net | 1 |

Dow Corning OS-10 consists of greater than 60 percent hexamethyldisiloxane (HMDS), which is a linear, volatile, completely methylated siloxane.

Mixture 3

| Ingredients | Volume Fraction |
|---|---|
| d-Limonene | 0.08 |
| Oxol 100 | 0.23 |
| Solvent 142 | 0.035 |
| SF 1202 | 0.38 |
| PRS | 0.1 |
| MOL | 0.0515 |
| Deionized water | 0.1235 |
| Net | 1 |

SF 1202 (CAS Number: 541-02-6) consists of greater than 90 percent decamethylcyclopentasiloxane.

Mixture 4

| Ingredients | Volume Fraction |
|---|---|
| d-Limonene | 0.08 |
| Oxol 100 | 0.22 |
| MOL | 0.16 |
| PRS | 0.003 |
| Dow Corning 244 fluid | 0.507 |
| Solvent 142 | 0.03 |
| Net | 1 |

Dow Corning 244 fluid consists of greater than 60 percent octamethylcyclotetrasiloxane Mixture 5

| Ingredients | Volume Fraction |
|---|---|
| d-Limonene | 0.08 |
| Oxol 100 | 0.22 |
| MOL | 0.16 |
| Calimulse PRS | 0.014 |
| SMO | 0.05 |
| Dow Corning 244 fluid | 0.319 |
| Solvent 142 | 0.157 |

Mixture 6

| Ingredients | Volume Fraction |
|---|---|
| d-Limonene | 0.16 |
| Oxol 100 | 0.46 |
| Solvent 142 | 0.065 |
| PRS | 0.014 |
| SMO | 0.05 |
| MOL | 0.251 |
| Net | 1 |

Example 2

Emulsion Preparation

A mixture of various components, such as any of Mixtures 1-6 set forth in Example 1, or any of Mixtures 7-9 set forth below, and optionally water, are placed in a mixer, such as Schold Mixer. The mixture is mixed at a rate of between 600-3600 rpm for 24 hours. The emulsion is obtained as a milky white liquid.

Stability tests show that the emulsion obtained by these methods remains stable, i.e., does not separate, for a period of at least two months.

Example 3

Mixture 7

In addition to the wash mixtures set forth in Example 1, above, the following mixture provides a particularly useful wash solution for cleaning rollers adapted for use with UV inks.

Mixture 7

| Ingredients | Volume Fraction |
|---|---|
| EB | 0.097 |
| Oxol 100 | 0.23 |
| Dow Corning 244 fluid | 0.33 |
| PRS | 0.007 |
| Norfox MSY | 0.336 |
| Net | 1 |

This formulation is a low VOC roller and blanket wash that effectively removes UV inks in a wide range of applications (sheet fed, automatic, web, heat set and variations thereof) while remaining economical. Mixture 7 contains no carcinogens or reproductive toxins listed by International Agency for Research on Cancer (IARC), National Toxicology Program (NTP), Occupational Safety & Health Administration (OSHA), or California Proposition 65.

In this formulation, Oxol 100 and Dow Corning 244 fluid are combined. Both fluids are U.S. Environmental Protection Agency (EPA) and California VOC exempt compounds. The mixture is designed to meet South Coast Air Quality Management District Rule 1171, effective Jan. 1, 2008 that requires solvent cleaning operations to use products with a VOC content of less than 100 grams per liter.

EB is 2-butoxy ethanol, also referred to as glycol ether. While EB is very effective as a solvent for UV ink, any of the other glycol ethers could be used for the 87 grams per liter of VOC.

Norfox MSY (methyl soyate) is a mixture of fatty acid esters, predominantly the methyl ester of linolenic acid at about 51.5%. MSY contributes about 12 grams per liter of VOC to the formulation.

Example 4

Mixture 8

A further wash mixture is provided as below:

Mixture 8

| Ingredients | Volume Percent |
|---|---|
| Deionized Water | 31 |
| Staramic 747 | 1 |
| Tapioca Dextrin 955 | 1 |
| Monosodium Phosphate | 3.4 |
| Igepal CO 990 | 0.5 |
| Citric Acid | 2.1 |
| Triethanolamine | 0.6 |

The above ingredients are mixed for 20-30 minutes before the below ingredients are added to the mixture.

| | |
|---|---|
| Mineral Spirits 142 | 12 |
| Dow Corning 244 Fluid | 23.2 |
| p-CBTF | 23 |
| Oleic acid | 2.2 |
| Ameristat 251 | 0 |
| Net | 100 |

This formulation is a low VOC plate cleaner that effectively removes inks in a wide range of applications (sheet fed, automatic, web, heat set and variations thereof) while remaining economical. Mixture 8 contains no carcinogens or reproductive toxins listed by IARC, NTP, OSHA or California Proposition 65

This formulation combines Oxol 100 and Dow Corning 244 fluid. Both are USEPA and California VOC exempt compounds. It is designed to meet South Coast Air Quality Management District rule 1171, effective Jan. 1, 2008 that requires solvent cleaning operations to use products with a VOC content of less than 100 grams per liter.

Mineral Spirits 142 is Ashland's trade name for a petroleum distillate with a flash point above 140 degrees Fahrenheit. Mineral spirits 142 could be replaced on a weight basis with virtually any solvent without substantial change in the effectiveness of the formulation. Mineral Spirits 142 could be replaced with water or Dow Corning 244 fluid to yield an effective zero VOC plate cleaner.

Upon drying, Staramic 747 and Tapioca dextrin 955 form a coating that protects the plate image during short term storage. This coating rinses off easily with water in combination with gentle agitation using a sponge.

Triethanolamine and oleic acid combine to increase the viscosity of Mixture 8.

Pre mixing may be omitted without noticeable deleterious effects to the formulation. The ingredients after the pre mix step were added slowly in order to form a viscous, stable emulsion. Ingredients are listed in the preferred order of addition, although the order of addition is not a necessary limitation. The ingredients can be added in any other order.

Example 4

Mixture 9

A further wash mixture is provided as below:

Mixture 9

| Ingredients | Volume Fraction |
|---|---|
| d-Limonene | 0.066202 |
| Oxol 100 | 0.300242 |
| Solvent 142 | 0.023 |
| Dow Corning 244 fluid | 0.347328 |
| Deionized water | 0.124274 |
| EPS-6113 | 0.138955 |
| Net | 1 |

EPS-6113 is a mixture comprising at least one basic component. It consists of the following components:

EPS-6113

| Ingredients | Fraction |
|---|---|
| Norfox 40 | 0.1 |
| Soda ash | 0.245 |
| Salt | 0.08 |
| Triton BG-10 | 0.07 |
| STPP | 0.485 |
| Sodium Metasilicate Pentahydrate | 0.02 |
| Net | 1 |

This formulation is a low VOC plate cleaner that effectively removes inks in a wide range of applications (sheet fed, automatic, web, heat set and variations thereof) while remaining economical. Mixture 9 contains no carcinogens or reproductive toxins listed by IARC, NTP, OSHA or California Proposition 65.

The essence of this formulation is the combination of Oxol 100 and Dow Corning 244 fluid. Both are USEPA and California VOC exempt compounds. It is designed to meet South Coast Air Quality Management District rule 1171, effective Jan. 1, 2008 that requires solvent cleaning operations to use products with a VOC content of less than 100 grams per liter.

STPP is sodium tripolyphosphate (or sodium triphosphate), with formula $Na_5P_3O_{10}$. It is used in various applications such as a preservative for seafood, meats, poultry and pet foods. It is also used in toothpaste and as a builder in soaps and detergents, improving their cleansing ability. The United States Food and Drug Administration lists STPP as "generally recognized as safe", along with salt, vinegar, and baking powder.

Norfox® 40 is a mixture marketed by Norman, Fox & Co. and comprises about 40% sodium dodeclybenzene sulfonte.

Triton® BG-10 is a mixture comprising about 70% oligomeric D-glucopyranose.

EPS-6113 provides detergent and scratch removal functionalities to Mixture 9. The active ingredient, sodium dodecylbenzene sulfonate, constitutes forty percent of Norfox 40. Triton™ BG-10 surfactant as represented by the Dow chemical company on MSDS #2265 dated Feb. 13, 2003 contains no reportable ingredients under sections 103, 302, 313 of 40 C.F.R. Parts 302.4 and 372. Additionally, MSDS #2265 states "This product contains no listed substances known to the State of California to cause cancer, birth defects, or other reproductive harm, at levels which would require a warning under the statute." Sodium metasilicate pentahydrate removes scratches from printing plates.

What is claimed is:

1. An emulsified composition comprising:

a hydrocarbon solvent present in between 11 to 50% by volume, wherein the hydrocarbon solvent comprises a branched alkyl chain, a cycloalkyl, a double bond, a triple bond, a hydrocarbon a mixture of at least C5-C30 hydrocarbons, an ether substituted with one or more alkoxy substituents and one or more hydroxyl substituents, or a combination thereof;

an aromatic solvent, wherein the aromatic solvent is 1-chloro-4-(trifluoromethyl)benzene, present in between 22 to 46% by volume;

a methylated siloxane present in between 31.5 to 75% by volume; and a surfactant present in between 15.2% and 75% by volume, comprising a salt or ester of a fatty acid;

wherein the emulsified composition is an emulsion that does not separate for a period of at least two months.

2. The emulsified composition of claim 1, wherein the methylated siloxane is selected from the group consisting of cyclic, branched, and linear methylated siloxane, or a combination thereof.

3. The emulsified composition of claim 1, wherein the hydrocarbon solvent is selected from the group consisting of limonene, lacolene, paraffins, and a combination thereof.

4. The emulsified composition of claim 1, wherein the methylated siloxane is selected from the group consisting of octamethylcyclotetrasiloxane, decamethylcyclopentasiloxane, dodecamethylcyclohexasiloxane, and a combination thereof.

5. The emulsified composition of claim 1, wherein the fatty acid is selected from the group consisting of caproic acid, caprylic acid, capric acid, lauric acid, myristic acid, palmitic acid, stearic acid, arachidic acid, behenic acid, myristoleic acid, palmitoleic acid, oleic acid, linoleic acid, alpha-linolenic acid, arachidonic acid, eicosapentaenoic acid, erucic acid, and docosahexaenoic acid.

6. The emulsified composition of claim 1, wherein the surfactant is a salt of an alkyl aromatic sulfonic acid.

7. The emulsified composition of claim 6, wherein the salt of the alkyl aromatic sulfonic acid is isopropylamine linear dodecylbenzene sulfonate.

8. The emulsified composition of claim 1, wherein the surfactant is selected from the group consisting of sorbitan monooleate, methyl oleate, and isopropylamine linear dodecylbenzene sulfonate.

9. An emulsified composition comprising a hydrocarbon solvent present in between 11 to 50% by volume, wherein the hydrocarbon solvent comprises a branched alkyl chain, a cycloalkyl, a double bond, a triple bond, a hydrocarbon a mixture of at least C5-C30 hydrocarbons, or a combination thereof;

1-chloro-4-(trifluoromethyl)benzene, present in between 22 to 46% by volume; and a methylated siloxane present in between 31.5 and 75% by volume;

wherein the emulsified composition is an emulsion that does not separate for a period of at least two months.

10. The emulsified composition of claim 9, wherein the methylated siloxane is selected from the group consisting of cyclic, branched, and linear methylated siloxane, or a combination thereof.

11. An emulsified composition comprising:

a hydrocarbon solvent present in between 11 and 50% by volume, wherein the hydrocarbon solvent comprises a branched alkyl chain, a cycloalkyl, a double bond, a triple bond, a hydrocarbon a mixture of at least C5-C30 hydrocarbons, an ether substituted with one or more alkoxy substituents and one or more hydroxyl substituents, or a combination thereof;

an aromatic solvent, wherein the aromatic solvent is 1-chloro-4-(trifluoromethyl) benzene, present in between 22 to 46% by volume; and a surfactant present in between 22 and 46% by volume, comprising a salt or ester of a fatty acid;

wherein the emulsified composition is an emulsion that does not separate for a period of at least two months.

12. The emulsified composition of claim 11, wherein the hydrocarbon solvent is substituted with one alkoxy substituent and one hydroxyl substituent.

13. The emulsified composition of claim 12, wherein the surfactant is a mixture of isopropylamine linear dodecylbenzene sulfonate and methyl oleate.

14. The emulsified composition of claim 12, further comprising water.

15. The emulsified composition of claim 11, wherein the hydrocarbon solvent is an ether substituted with one or more alkoxy substituents and one or more hydroxyl substituents.

16. The emulsified composition of claim 11, wherein the surfactant is selected from the group consisting of isopropylamine linear dodecylbenzene sulfonate, methyl oleate, and a combination thereof.

* * * * *